United States Patent [19]

Heller

[11] Patent Number: 4,986,543

[45] Date of Patent: Jan. 22, 1991

[54] SINGLE AND/OR DOUBLE PLAYER PINBALL MACHINE

[76] Inventor: Earl A. Heller, Hopi Trail, R.D. 5, Box 17, Oak Ridge, N.J. 07438

[21] Appl. No.: 450,087

[22] Filed: Dec. 13, 1989

[51] Int. Cl.[5] ..... A63F 7/00

[52] U.S. Cl. ..... 273/121 A; 273/118 A; 273/119 A; 273/122 A

[58] Field of Search ..... 273/118 R, 118 A, 118 D, 273/119 R, 119 A, 121 R, 121 A, 121 D, 121 E, 122 R, 122 A, 123 R, 123 A, 124 R, 124 A, 125 R, 125 A; 200/61.11

[56] References Cited

U.S. PATENT DOCUMENTS

| | | | |
|---|---|---|---|
| 3,675,927 | 7/1972 | Gottlieb et al. | 273/119 A |
| 4,109,916 | 8/1978 | Breslow et al. | 273/121 A |
| 4,176,844 | 12/1979 | Ryan et al. | 273/121 A |
| 4,606,545 | 8/1986 | Ritchie | 273/121 A |
| 4,840,375 | 6/1989 | Lawlor et al. | 273/121 A |

*Primary Examiner*—Edward M. Coven
*Assistant Examiner*—Raleigh W. Chiu
*Attorney, Agent, or Firm*—Richard A. Joel

[57] ABSTRACT

A pinball machine which may be played by a single player for a pair of players either playing against one another or as a team. The invention comprises a pair of pinball playing fields joined together at one end and having a common scoreboard, typically protruding vertically upward therefrom. The machine may be played by a single player in a mode wherein a divider separates the two playing fields, which can be mirror images of one another, or can be completely different in design or theme. In a dual player mode, the divider is retracted and the player may play on his own field as well as the other field. The flippers on the opposite field may also be controlled by a player. In this manner, the opposing player gains some degree of control over the opposite playing fields to enhance the chances of scoring. In a further embodiment, it is possible to play the game on a second level or in an arrangement wherein the playing fields are put together back to back and the scoreboard extends vertically above the two playing fields. The versatility of having a single or double arrangement is attractive to players and presents innumerable additional possibilities for play.

5 Claims, 3 Drawing Sheets

SINGLE AND/OR DOUBLE PLAYER PINBALL MACHINE

BACKGROUND OF THE INVENTION

In pinball games, every possible option has been used to attract players but interest in the game often wanes after playing for a period of time. The present arrangement, however, permits a player to elect one of two options before beginning, i.e., a single player mode wherein a central divider is not released and keeps adjacent playing fields totally separated into two separate games and a dual player mode wherein the play starts simultaneously on the adjacent separated fields. Once a predetermined objective is achieved, the divider or barrier between fields is lowered and the player or players enter the opposite field of play with the control of the upper flippers changing to the opposing side. Subsidiary features include a new thermometer type scoring display for rapid viewing and a new type pivotal flipper.

The prior art includes U.S. Pat. No. 3,894,737 to Moore which discloses a game board apparatus including two or more identical base structures hinged together. A plurality of interchangeable plates may be associated with each base structure and balls cross over the center line but only if propelled too hard.

U.S. Pat. No. 4,273,341 to Warrix discloses a game device played by one or two persons in upstanding left and right compartments separated by a middle wall. Pendulums are used to dump projectiles through a window in the dividing wall into the opponent's compartment. The design of this game is quite different from the present setup.

U.S. Pat. No. 4,380,335 to Chaudry discloses a pinball game having two or more flipper-equipped player goal positions at opposite ends. This arrangement is somewhat typical of the conventional two player arrangement over which the present invention is an improvement. Finally, U.S. Pat. No. 4,606,505 discloses a two-level arrangement of upper and lower playing fields but in a single player game. In summary, the precise structure of the present invention is not shown in the prior art, specifically, a dual playing field game which may be played by one or two players or by teams.

SUMMARY OF THE INVENTION

The present invention relates to a new and improved double pinball arrangement which may be played by single or double players or by a team. The preferred embodiment of the invention involves mirror image playing fields which are joined at one end wherein a upwardly projecting scoreboard stands. A divider separates the games into separate playing arrangements, but this divider is retracted when the player selects either a double player mode or a team player mode. In such case, balls may be hit into the adjacent playing field where the opposing player controls a set of flippers to provide a control over the ball movement. The players may either play against one another simultaneously or as a team to achieve a high score.

In other preferred embodiments of the invention, the playing fields are situated opposite one another in an elongated fashion. Similarly, in this case, the balls go over into the opposite playing field when a certain point in play is reached and a divider is lowered. Additional features include a thermometer type scoring arrangement and a unique flipper arrangement.

Accordingly, it is an object of this invention to provide a new and improved single, double or team play pinball arrangement.

Another object of this invention is to provide a new and improved pinball arrangement wherein mirror image playing fields, or totally different playing fields, are separated by a divider which is lowered at a certain point in the game to permit playing on an opposite field, and, A more specific object of this invention is to provide at least two pinball playing surfaces which are joined together on one or two levels to permit players to move into an opposite playing field upon a certain point in the game or to remain put and play a single game for scoring purposes.

BRIEF DESCRIPTION OF THE DRAWINGS

The above and other objects and advantage of the current invention may be more clearly seen when viewed in conjunction with the accompanying drawings wherein.

DETAILED DESCRIPTION OF THE INVENTION

Figure 1:
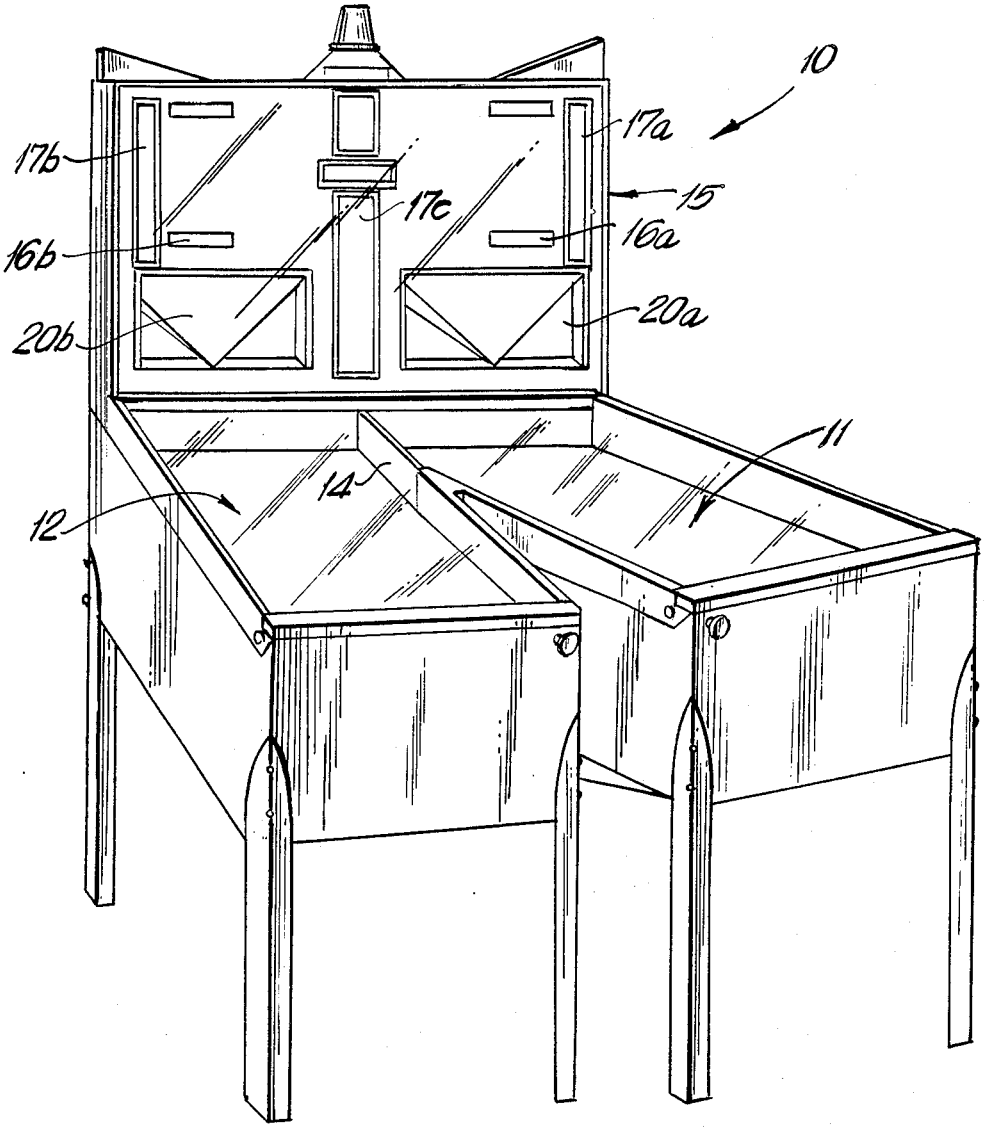
FIG. 1 is a plan view of the dual pinball machine comprising the present invention (shown with mirror image playfields)

The invention comprises a pinball machine 10 having dual playing fields 11 and 12 arranged at an angle to one another. The playing fields 11 and 12 are joined at their upper end portion to a vertically projecting scoreboard 15 so that it is possible to play on a single playing field 11 or on both playing fields 11 and 12. The players may play the pinball game in a single player mode wherein a central divider or barrier 14 does not release, keeping the playing fields 11 and 12 separated into two individual games. Each player will then proceed to play on his or her respective half of the machine 10 in much the same way as a conventional pinball game is played today. Thus, the machine 10 is actually comprised of two separate machines joined angularly at one end with a common vertical scoring display 15. Display 15 includes a conventional numerical display **16*a* and 16*b* and a thermometer type display 17*a* and 17*b* on each side which enables the player to obtain an instantaneous view of the score. Indicator lights 20*a* and 20*b*** are also provided.

The playing fields 11 and 12 are mirror images of each other but nevertheless although they are the same, the player receives a whole new perspective when changing from one side to the other. This increases the frequency of play. Another anticipated result is that there will also be an extension in the longevity of the machine as a spinoff. In the description, the conventional elements of the game are well-known and hence are not described herein.

The double or dual player mode is the most unique and exciting feature of pinball play comprising the present invention. In this mode, two players begin their play simultaneously on separate playing fields 11 and 12.

Once the correct sequence of targets has been achieved or completed by the players, the separation of playing fields 11 and 12 would be eliminated by the lowering or raising of the separating barrier or barriers 14. The players are then allowed to enter each other's field of play. In addition, once the barrier 14 have been opened for dual play, the control of the upper outside flippers 19*a* and 19*b* could be transferred to the other player. In this manner, each player would control a flipper 19*a* or 19*b* in the opponent's play field giving them the opportunity to help control his or her own destiny while allowing players to assist each other in scoring against the machine. The players would be forced to watch the action on both playing fields 11 and 12 as the ball is switched from playfield 11 to playfield 12 and vice versa. It is also possible to play the game in a multi-ball mode which will allow even greater excitement and fast play action.

In addition to a vertical score display, the main portion of the scoreboard 15 would display a thermometer type of scale or display 17*a*, 17*b* and 17*c* also called a bar scale (for the combined score in team play). This thermometer type of scoring display would allow both players as well as onlookers a very quick reference as to the player's score. The top of the scale could be the replay score with the machine adjusting advancement of the score grid upwards proportionately towards the replay score. The pinball machine 10 of FIG. 1 shows 3 separate bar-type scoring scales. The two smaller scales 17*a* and 17*b* will show each player's individual bar scale score display. The third and larger bar scale 17*c* will show a combined score of both players against the machine. This combined score will encourage players to team up to work together to beat the machine. This arrangement will also give players a fire double option, that is, (a) they will be able to compete against one another to see who can obtain the highest score; and (b) they can work together to help one another to achieve the highest possible combined scores to beat the machine 10.

Figure 2:
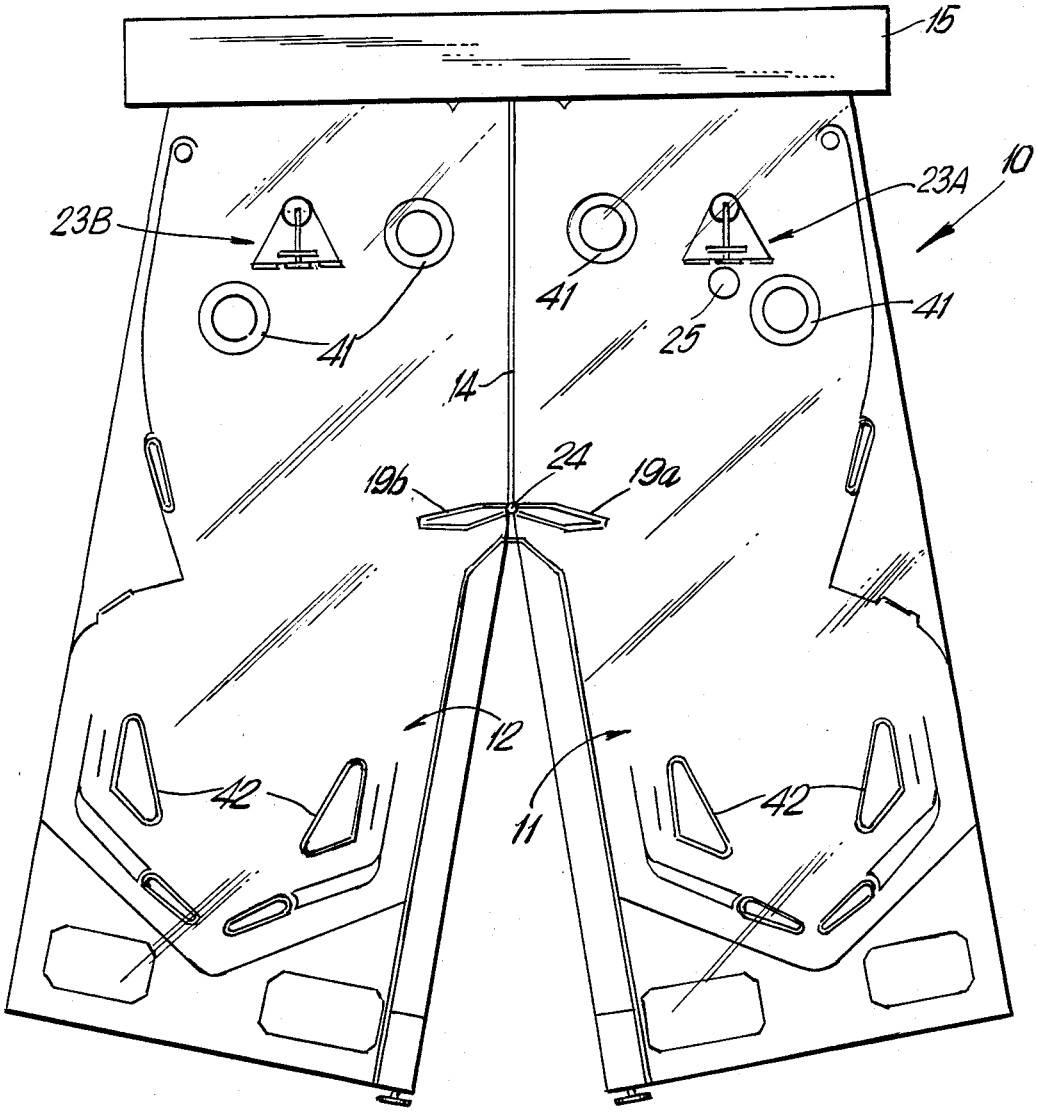
FIG. 2 is a top view of the invention with portions shown in phantom.

In the top view of play fields 11 and 12, shown in FIG. 2, are pivoting flippers 19*a* and 19*b* on each side. The flippers 19*a* and 19*b* permit a unique type of control by the players since the flippers each have a pivot point 24 in the middle. As the right side of the flipper goes up, the left side goes down. Working together players can trap, pass or steal the ball as it enters the upper play field area. This adds to both competitiveness, teamwork and skill levels during play.

The special design of the pivoting flippers 19*a* and 19*b* also prevents powerful flips of the ball 25 in a confined area. This promotes more controlled, less powerful flips due to the short length of the pivoting portion due to the center pivoting point 24.

On the illustrated embodiment, the left button would push the left side of the flipper upwards (and conversely the right side of the flipper downwards) and the right button would push the right side of the flipper upwards (and consequently the left side of the flipper downwards).

The various bumpers 41 and 42 are not described at length herein since they are conventional as is the basic operation of the pinball game.

Since the right play field 11 is a mirror image of the left play field 12, much of the design pertaining to electronics can be repeated. In addition, manufacturing runs can simply be doubled for assembly, cutting down on the production costs. Finally, although there is a difference between right and left hand sides to some of the parts, their symmetrical design will allow tooling and design to be adapted rather than completely reworked.

Finally, items such as artwork could be adapted or simply modified so that design costs would be greatly reduced. The game is an innovation that brings a new dimension to pinball play that has never before existed—cooperative team play with the players uniting against a common foe, the machine 10. Furthermore, neither player is forced to wait until another has played. Now two players can play continuously at the same time.

Figure 3:
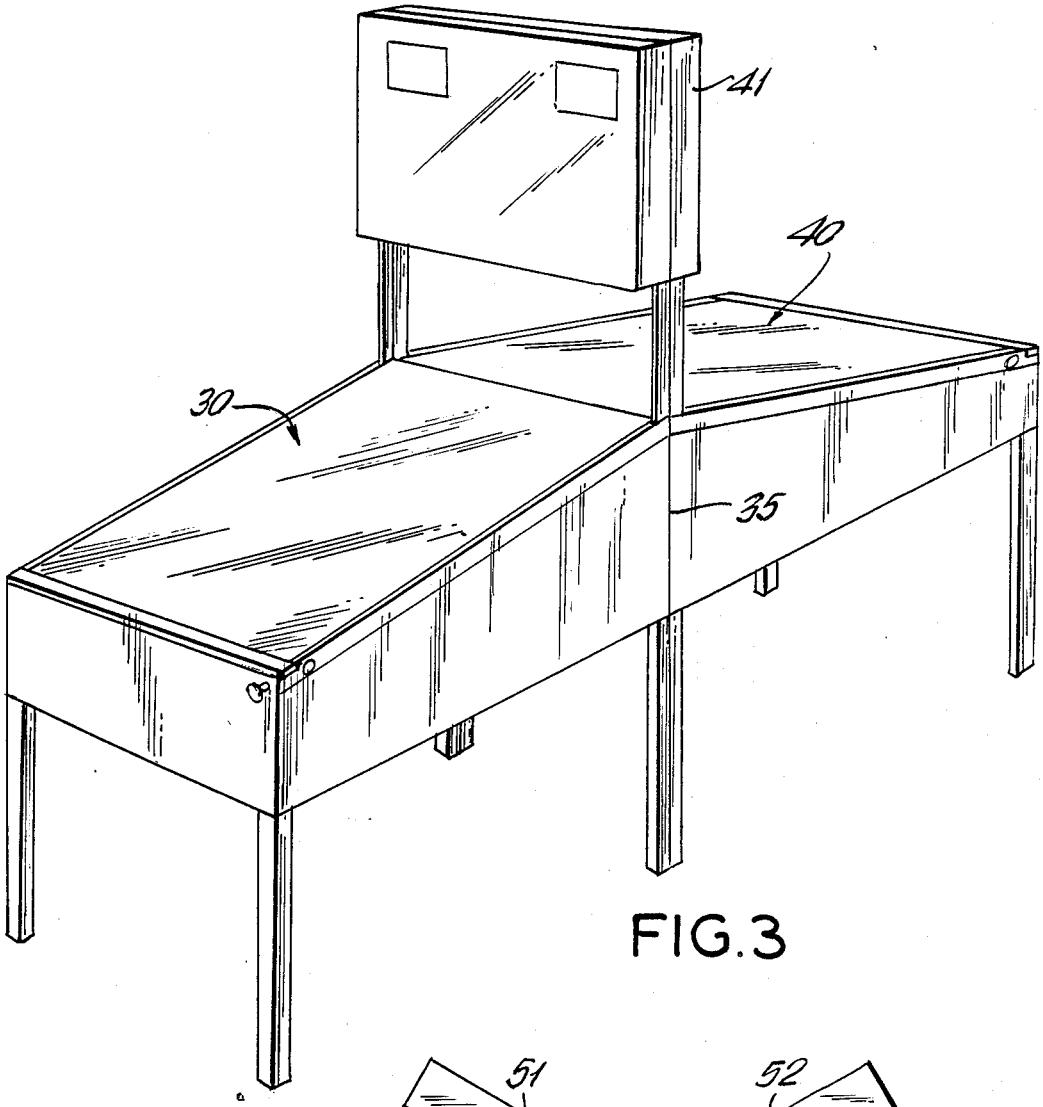
FIG. 3 is an alternate embodiment of the invention with the dual playing fields laid out back to back.

FIG. 3 depicts another arrangement where the games 30 and 40 are arranged back to back with the divider 35 separating the games 30 and 40. The scoreboard 41 projects upwardly between the games 30 and 40 and is similar to that previously described but has a double face.

Figure 4:
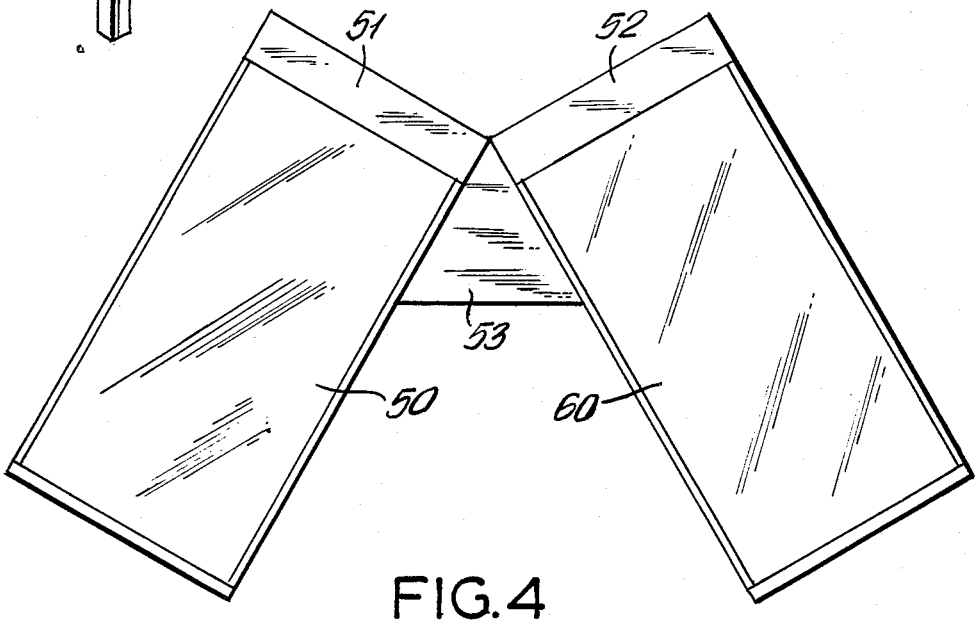
FIG. 4 is a top view of the dual playing field arrangement similar to FIG. 1 but somewhat modified.

The embodiment of FIG. 4 shows games 50 and 60 similar to FIG. 1 but with separate scoreboards 51 and 52 and a crossover area 53. This arrangement is somewhat simpler to break apart into separate games.

While the invention has been explained by a detailed description of certain specific embodiments, it is understood that various modifications and substitutions can be made in any of them within the scope of the appended claims which are intended also to include equivalents of such embodiments.

What is claimed is:

1. A dual pinball machine comprising:

a first playing field and a second playing field positioned at an angle to one another, said fields being joined on one side towards the end portions thereof, a retractable barrier separating the fields at their juncture, a vertical scoreboard mounted at the end of the playing fields wherein the fields are joined together, and, means for raising the barrier to exclude playing on both fields simultaneously or for lowering the barrier to permit playing on both fields simultaneously, one or more flippers on each playing field, and means for shifting control of the flippers on one field to the opposite field under predetermined conditions.

2. A dual pinball machine in accordance with claim 1 wherein:

the scoreboard includes a plurality of thermometer-type scoring displays to permit ready viewing of the scores.

3. A dual pinball machine in accordance with claim 1 wherein:

the first and the second playing fields are positioned end to end in a substantially horizontal arrangement with the barrier therebetween and the scoreboard extending vertically upwards between said fields.

4. A dual pinball machine comprising:

a first playing field and a second playing field with said fields joined along one side thereof, at least one barrier separating the fields along their juncture, said barrier being capable of being raised above the surface of the playing field to exclude playing on both fields or lowering the barrier to permit playing on both fields simultaneously, a vertical scoreboard mounted at one end of the playing fields, at least one flipper on each playing field, and, means for shifting control of the flippers on one field to the other field under predetermined conditions.

5. A method for operating a dual pinball machine comprising the steps of:

providing a first and a second playing field joined along one side, providing a retractable barrier between the playing fields which initially separates the fields, operating each playing field in a conventional manner, retracting the barrier at a predetermined point in the game to permit playing on an opposite field, and, shifting control of flippers to the opposite field.

* * * * *